US005355904A

United States Patent [19]

Wallum

[11] Patent Number: 5,355,904

[45] Date of Patent: Oct. 18, 1994

[54] STAIR CLIMBING AID

[76] Inventor: Ronald I. Wallum, P.O. Box 5282, Fargo, N. Dak. 58205

[21] Appl. No.: 130,746

[22] Filed: Oct. 4, 1993

[51] Int. Cl.[5] ..... A45B 1/00

[52] U.S. Cl. ..... 135/65; 135/75; 182/16; 182/106; 182/129

[58] Field of Search ..... 135/65-67, 135/74, 75, 77; 182/16, 62.5, 106, 129, 151, 156, 228; 52/118, 632, 243.1, 730.1, 126.1, 127.2, 127.11, 122.1, 183, 182

[56] References Cited

U.S. PATENT DOCUMENTS

| | | | |
|---|---|---|---|
| 2,044,260 | 6/1936 | Schiele . | |
| 2,642,074 | 6/1953 | Pedley et al. . | |
| 2,782,796 | 2/1957 | Blue . | |
| 2,930,564 | 3/1960 | Maier | 248/228 |
| 3,207,260 | 9/1965 | Castagna . | |
| 3,381,775 | 5/1968 | Livers . | |
| 3,578,110 | 5/1971 | Seagraves . | |
| 3,826,336 | 7/1974 | Cramer . | |
| 3,841,437 | 10/1974 | Caughey . | |
| 3,884,327 | 5/1975 | Zigman . | |
| 4,113,161 | 9/1978 | Manuszak . | |
| 4,250,977 | 2/1981 | Deli . | |
| 4,258,735 | 3/1981 | Meade . | |
| 4,274,430 | 6/1981 | Schaff et al. . | |
| 4,378,862 | 4/1983 | Carmel . | |
| 4,844,199 | 7/1989 | Nimz . | |
| 4,998,298 | 3/1991 | Mitchell | 182/106 X |
| 5,131,494 | 7/1992 | Heifetz . | |

*Primary Examiner*—Carl D. Friedman
*Assistant Examiner*—Lan C. Mai
*Attorney, Agent, or Firm*—Schroeder & Siegfried

[57] ABSTRACT

A stairway climbing aid having a plurality of individual adjustable half-step members fixedly connected to a rigid elongated channel member at spaced locations along the length of the latter to comprise a rigid assembly. The channel member is connected to each of the half-step members adjacent the rear end of the latter and at an elevation and angle such that the channel member will extend upon or adjacent the outer edge of the tread of each step. The half-step members are longitudinally adjustable so that their length can equal the depth of the particular steps to which they are applied. Thus, any stairway can be readily modified to facilitate travel thereover by persons having difficulty in taking full steps, by applying such an assembly to the steps along one side of the stairway, after adjusting the individual half-steps to the depth of the treads.

20 Claims, 5 Drawing Sheets

STAIR CLIMBING AID

BACKGROUND OF THE INVENTION

A substantial portion of the modern population has serious difficulty in ascending and descending stairways. This is becoming ever more common as the elderly substantially increase in numbers, as has been the case in recent years. In addition to the elderly, the lame, crippled, convalescents, and others suffering from various infirmities find great difficulty in traversing such stairways. This problem has been with us for centuries and is ever-increasing, simply because the numbers of those needing assistance is ever-increasing. Various attempts have been made in the past with different degrees of success or lack of success. None, however, offer a completely satisfactory solution and the use of all of them require physical exertion which is found to be excessive for most elderly and infirm individuals.

Evidence of the above is found in the various patents which have been issued to individuals who have sought to overcome or diminish this problem over the past half century. Thus, U.S. Pat. No. 2,782,796, issued on Feb. 26, 1957, demonstrates the use of a half-step which reduces the vertical step required by the user to one-half the vertical distance, although it doubles the number of steps required to be taken. A staff 14 is provided as a means for the user to steady himself and to facilitate lifting the half-step to the next step of the stairway, without the benefit of the steadying influence of the staff 14. Such movements are a source of real danger to one who is already unsteady and thus require sufficient effort so that repetition thereof, becomes excessively tiring.

A second U.S. Pat. No. 3,841,437, issued in 1974, upon a portable step stool, which suggests a step at a first level and a platform at a higher level. It also offers an intermediate or half-step, when the original step is too great for the user. Again, infirmity is recognized and only partly provided for by the provision of a vertical staff 24.

U.S. Design Pat. No. 287,283, issued on Dec. 16, 1986, shows a portable half-step stairway unit which has a slot in its side, apparently to facilitate grasping the unit manually and moving it vertically from step to step. It appears to have an anti-skid material over its weight-supporting surface to diminish the likelihood of serious falls by the user. Again, its use involves substantial effort in moving the device from step to step, which creates dangerous situations.

On Mar. 31, 1991, U.S. Pat. No. 4,258,735, issued on a step assisting device, which again is comprised of a half-step member and walking stick combination. Again, however, the user is required to lift the walking stick and attached half-step member from step to step, if the user is to successfully climb the stairway.

U.S. Pat. No. 4,844,199, issued on Jul. 4, 1989, shows a stair climbing aid designed to assist a handicapped person in moving up and down a flight of stairs. The device consists of a pair of vertically spaced platforms, with an attached vertically extending handle, designed to assist in moving from one step of the stairway to an adjacent step, and thereafter requiring movement of the entire unit to that adjacent step.

A solution to the problems outlined above was being sought as late as Jul. 21, 1992, as evidenced by the issuance of U.S. Pat. No. 5,131,494, on an Effective Riser Reducer Step Device. It too shows a half-step device with an upstanding handle for lifting the same from step to step, successively, as the user progresses along the stairway.

All of the above devices have serious disadvantages. One is that substantial effort is needed on the part of the user to repeatedly move the half-step from step to step, as required. Another is that the user must rely upon an upstanding handle which is no more stable than the half-step member, which necessarily is moved from step to step. Still another is that the half step is movable and not anchored, Kith consequent instability and danger to the already unstable user from shifting of the half-step relative to the tread.

BRIEF SUMMARY OF THE INVENTION

My invention is directed toward providing a simple but effective and more stable, and hence safer, stairway climbing aid. As shown, it includes a plurality of adjustable half-step members, each fixedly connected to an elongated connector at spaced points along the length thereof, so as to be arranged in relatively fixed, vertically spaced relation upon the steps of the stairway when the half-steps are placed so as to bear against the riser of each step. In this position, the connector may rest upon the front edges of the treads of the individual steps of the stairway for additional stability. When the connector is so disposed along one end of the steps, adjacent the conventional hand-rail, with the forward end of each half-step abutting the riser of the step on which it is so disposed, a very stable, safe, and relatively effortless climbing aid is provided. This device enables the user to have both hands free to assist in maintaining good balance. The connector is comprised of an elongated rigid channel member which facilitates assembly of the unit in accomplishing a simple fixed connection to the individual half-steps.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

The preferred embodiment of my invention is shown in FIGS. 1–7, inclusive. Since the dimensions of stairways differ somewhat, it may be preferable to utilize a half-step which has a slightly greater vertical height for steps where the riser is greater. Most stairways have risers having a vertical dimension of 6½" to 7½". In view thereof, my half-step may preferably be utilized with vertical dimensions of 3" to 4¾". Also, various stairways have treads of different depths. The depth of the treads may vary between 8" to 12" and, as a consequence, the angle at which the connector of my various half-step units is connected and extends relative to such units will vary from approximately 27° to 44°, relative to the horizontal upper surface of the half-step unit and/or, the upper and lower horizontal edges thereof.

Figure 3:
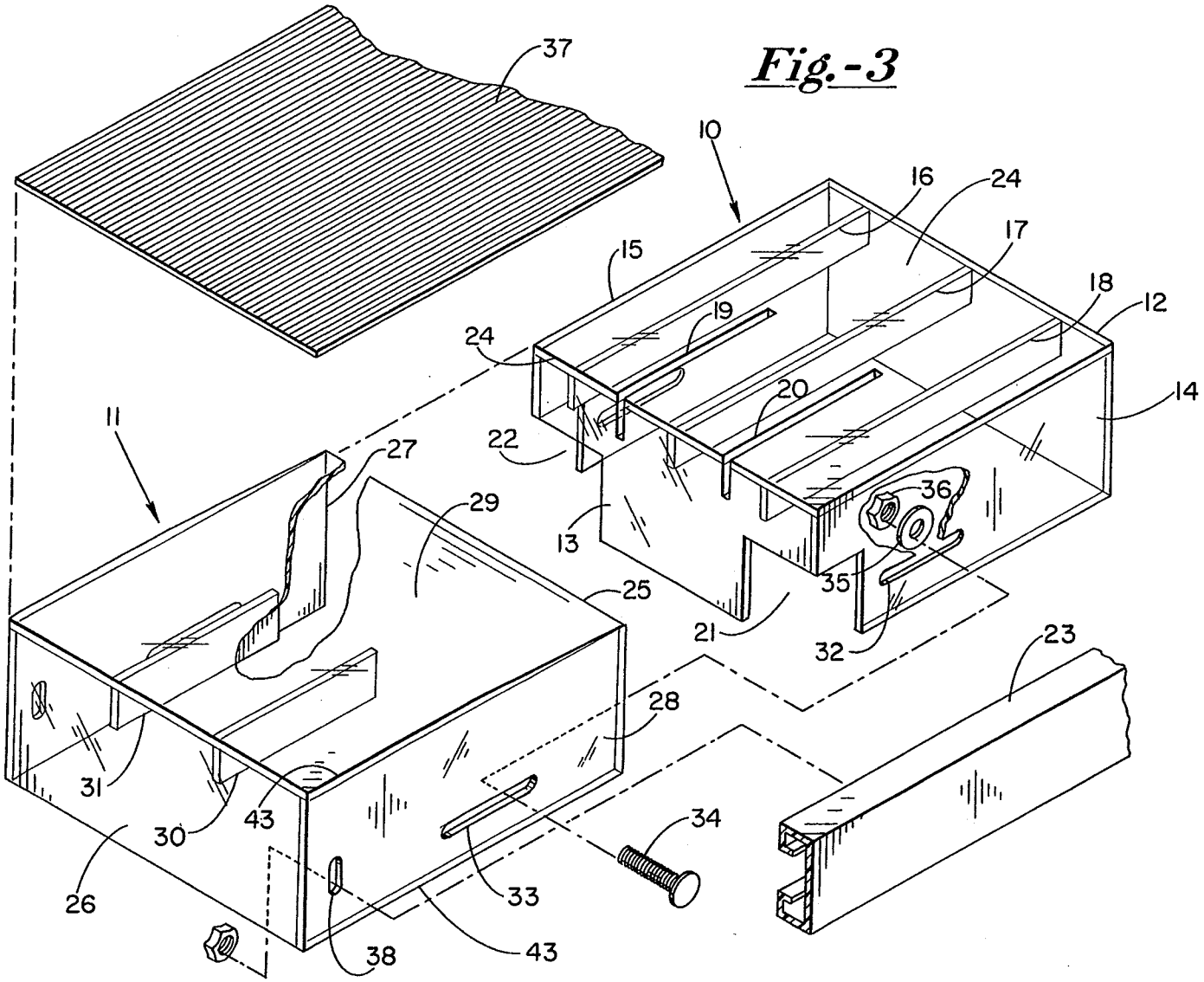
FIG. 3 is an exploded view of one of my adjustable half-steps showing the particular construction thereof.
Figure 4:
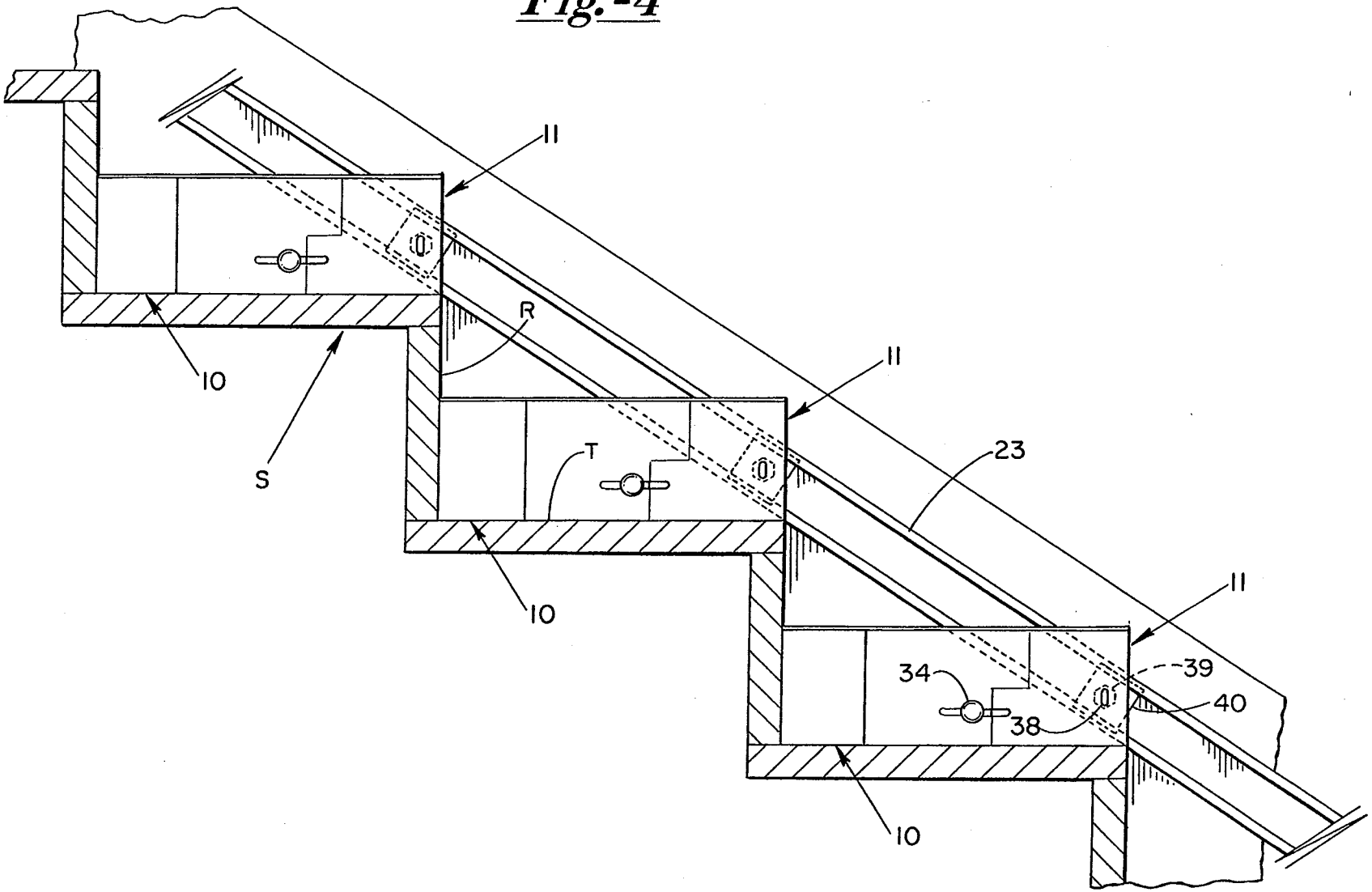
FIG. 4 is a vertical sectional view of a plurality of stair steps with a portion of one of my stairway climbing aids positioned thereon and showing the latter in elevation.

As best shown in FIG. 3, one of my half-step units may be comprised of two box-like structures, the forward and innermost one of which is designated by the numeral 10 and the rearward and outermore one being designated by the numeral 11. As shown, these two box-like structures may be manufactured of clear plastic material, which can be molded. In view thereof, there is a slight taper in the outer walls of each of the unit to facilitate their removal from the molding die. As shown, the slightly smaller unit 10 telescopes into the slightly larger unit 11, and is shiftable between a variety of positions to provide a half-step unit having adjustable horizontal dimensions exactly equal to or slightly smaller than the depth of the tread of the stairway to which the unit is to be applied.

As shown in FIG. 3, the slightly smaller unit 10 has a front wall 12, a rear wall 13, and opposite sidewalls 14 and 15. Three strengthening ribs 16, 17, and 18, extend between the front and rear walls and depend within the interior from the top horizontal wall 24. The rear wall 13 and sidewalls 14 and 15 are relieved at the rear corners, which have been designated by the numerals 21 and 22, in order to facilitate connection to the elongated channeled connector 23. The bottom of the unit 10 is open.

The outer and slight larger box-like unit 11 is of the same general shape and slightly larger than the previously described unit 10. As shown, it has an open front end 25, since there is no front wall provided. It has a rear wall 26 and two sidewalls 27 and 28, along with a horizontal top wall 29. This unit is also open at the bottom and has a pair of interior depending guides 30 and 31, which are positioned so as to match and extend into the slots 19 and 20, which are found in the unit 10. Thus, the unit 10 can telescope into the interior of the unit 11, so that the overall length thereof is readily adjustable to a dimension equal to the depth of the tread of the stairway to which the unit is to be applied.

To facilitate rigid connection between the two units 10 and 11, there is a slot 32 formed in the inner box-like unit 10 and a corresponding slot 33 formed in the outer box 11. These slots are positioned so as to correspond and meet when the two units are telescoped and are designed to accept a bolt 34 which extends through the two slots to receive a washer 35 and a nut 36. Thus, when the two units are telescoped to the desired length, which is the depth of the tread of the stairway to which the unit is to be applied, the nut 36 can be tightened to hold the two units in fixed telescoped position. This connection can be best accomplished by inverting the two box-like units, adjusting their relative positions so that their total length equals the depth of the tread of the stairway upon which it is to be used, and then tightening the nut 36 with a wrench through the open bottom. Similar slots, bolts, nut, and washer are provided at the opposite side, as shown.

As shown in FIG. 3, a non-slip rubber panel 37 is supplied, with pressure-sensitive adhesive applied to its underside to secure same to the upper surface of the telescoped unit. It is provided with a length sufficient to cover the unit when extending to its maximum length. Thus, when the desired length of the unit is determined and the box-like members are secured to each other, as described, the panel 37 is applied to the upper surface of the unit, and the excess of panel 37 is severed.

Figure 6:
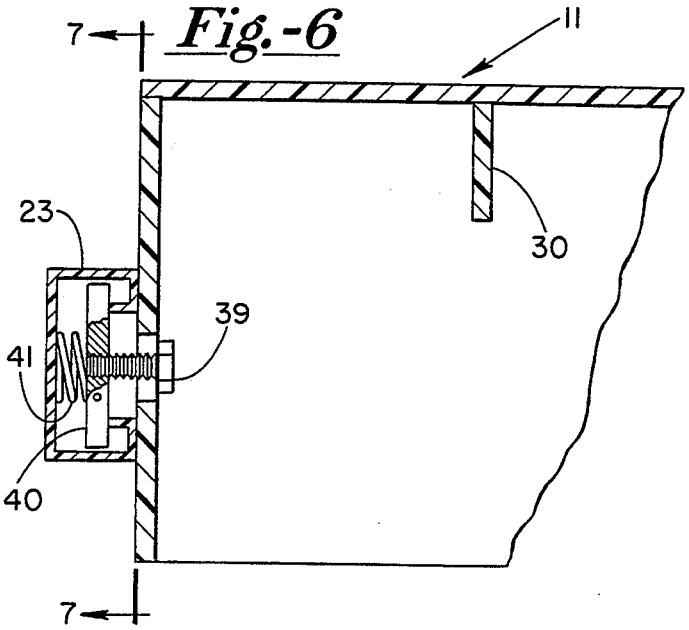
FIG. 6 is a fragmentary sectional view on an enlarged scale taken along line 6—6 of FIG. 5.
Figure 7:
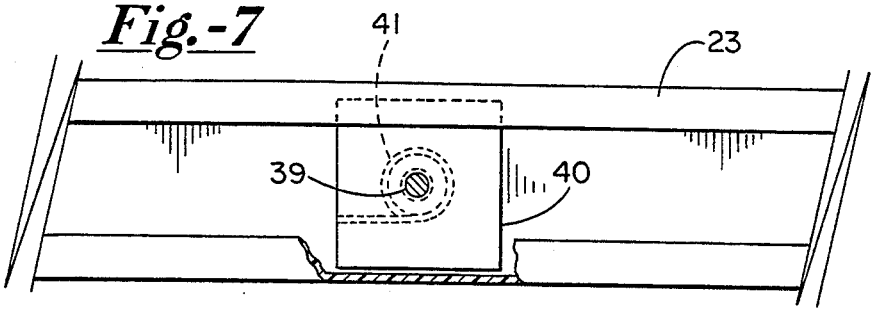
FIG. 7 is a fragmentary vertical sectional view taken along line 7—7 of FIG. 6.

As indicated hereinbefore, the connector 23 is an elongated rigid channel member which may be made of molded plastic in order to reduce expense, or of relatively inexpensive metal. As shown in FIG. 3, the slightly larger unit 11 has a vertically extending slot 38 located adjacent its rearwardmost corner and slightly below midway between the top and bottom surfaces of the unit 11. A bolt 39 is inserted through this slot from within the unit 11, and a rectangular nut 40 is threaded thereon. This nut 40 is positioned within and has dimensions slightly smaller than the width of the channel of the connector member 23, as best shown in FIG. 6, and is provided with a spring element 41, which functions to slidably hold the nut and bolt 39 and 40 temporarily in whatever position it may be moved to within the channel of the connector 23. Once the various telescoped units are connected in this manner to the connector, their exact position may be determined as described hereinafter.

To ensure that the various telescoped half-step units are secured to the connector 23 at the appropriate relative positions, one of each of the telescoped units is positioned upright upon each of the treads T of the stairway with a spacer (not shown), such as a short section of wooden 2×4's, positioned immediately ahead of each of the telescoped units, between the riser R and the unit. Thus, the rearward end portion of each of the telescoped units will thereby extend rearwardly over the rearward edge of each of the treads of each step a distance equal to the horizontal thickness of the spacer, and ready access will be provided to the nut 40 so that it may be tightened with a wrench from below, in order to thereby secure the telescoped units at the appropriately spaced points along the length of the connector 23.

Figure 1:
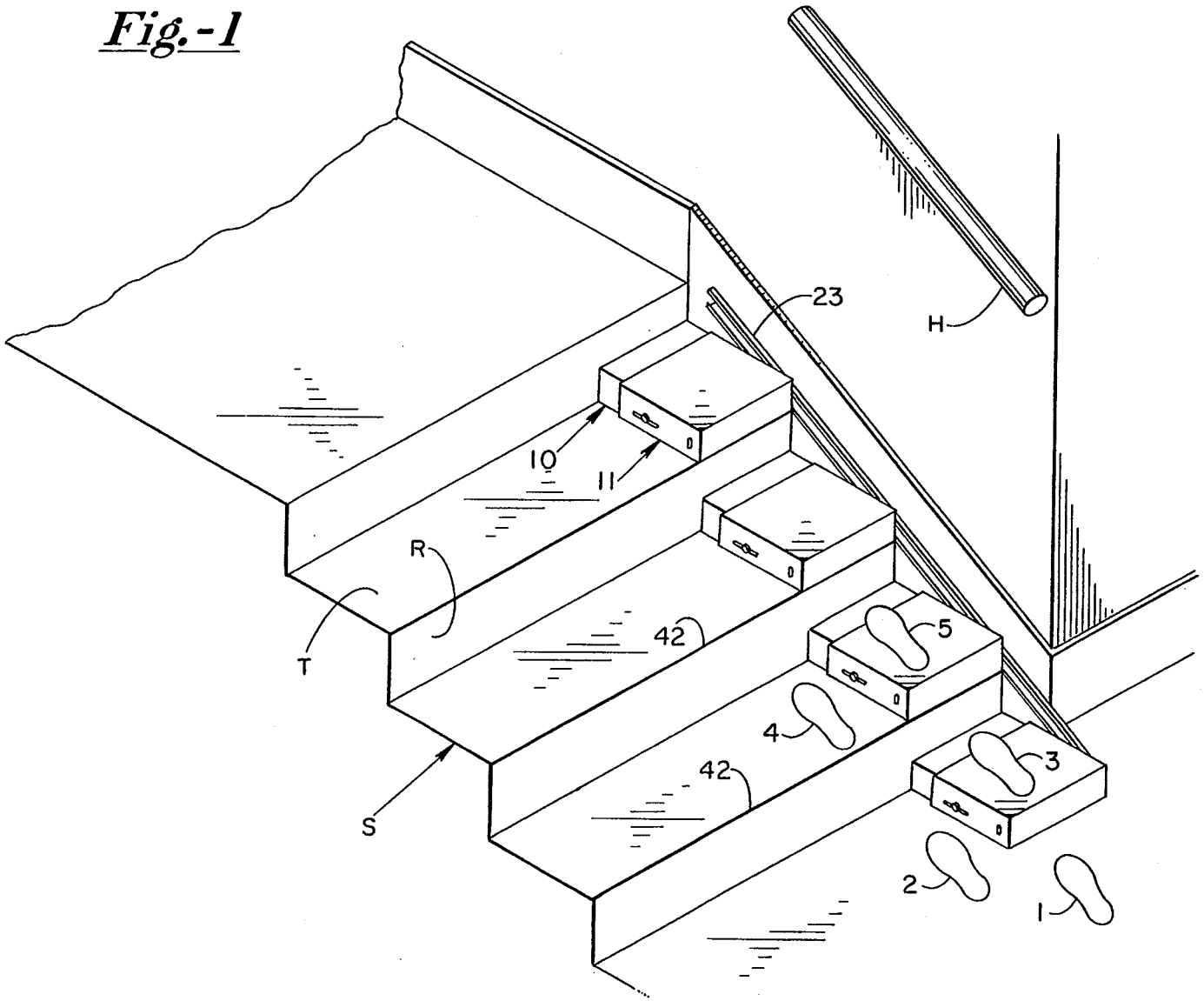
FIG. 1 is a perspective view of a conventional stairway with one of my Stairway Climbing Aids applied to the steps thereof.
Figure 2:
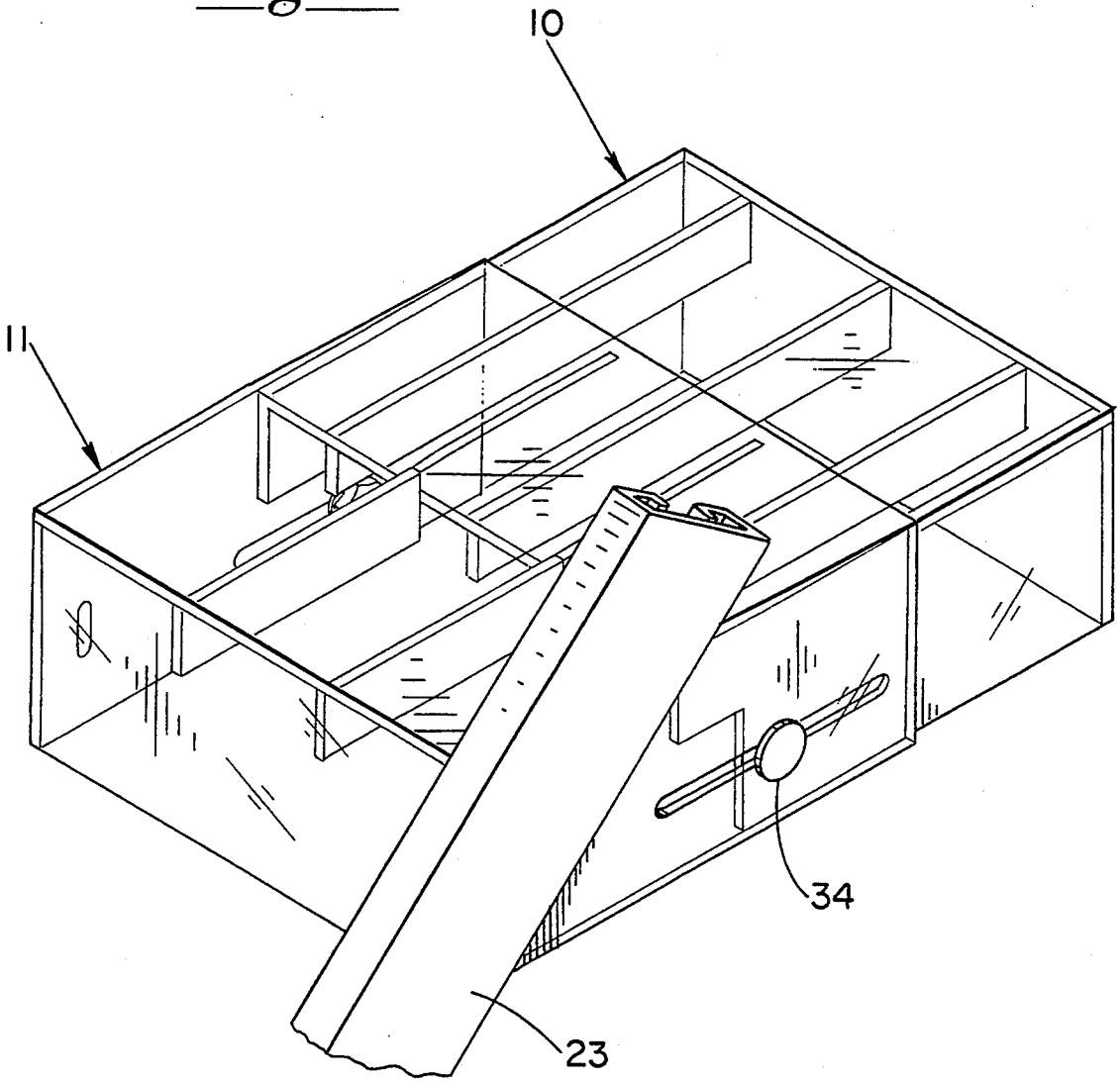
FIG. 2 is a perspective view on a substantially larger scale of one of my half-step units with a portion of a connector secured thereto.

When these fixed connections have been accomplished, the entire unit has been assembled and upon removing the spacers referred to hereinabove, the entire unit may be slid forwardly until the unit 10 of each of the half-steps will abut against the riser R of its associated step. Thus, the entire unit is portable and can be slid into position, as shown in FIG. 1, with the elongated connector 23 abutting the side board which extends along the end of the steps S adjacent the rail H, as shown. Since the forward end of each of the half-steps abuts against its corresponding riser R, and the connector 23 bears against the side board and may rest upon the rearwardmost edge 42 of the step, it is impossible for any slippage to occur and great stability is afforded adjacent the rail R, so that the user may utilize both hands, if desired, in traversing the steps and the half-steps, as shown in FIG. 1.

Figure 5:
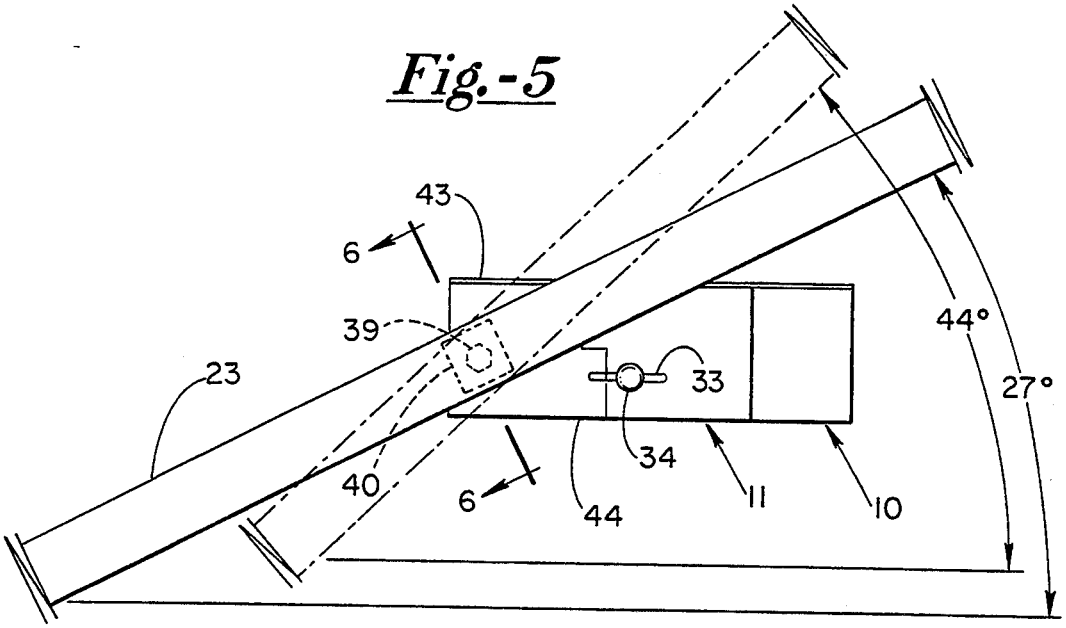
FIG. 5 is a side elevation of one of my adjustable half-steps, with a section of the connector connected thereto and illustrating the preferred range of angle between the connector and the upper horizontal surface of the half-step.

As best shown in FIG. 5, the connector 23 may extend at an angle to the upper horizontal surface of the various half-steps and/or to the upper and lower edges 43 and 44 of the sidewalls, at an angle within the range of 27° to 44°. This is true because of the possibility of differences in the depth of the tread and the height of the risers of the various stairways to which the unit may be applied. As a result of these variations, the half-step units will be evenly spaced approximately 11" to 14" apart along the connector 23.

When positioned properly for use, as shown in FIG. 1, a person utilizing the same will take the steps as shown in FIG. 1, wherein each of the steps have been identified with numerals 1–5 to illustrate the successive steps as they will be taken. It will be readily seen that as a consequence, each of the steps may be negotiated by a user taking only a half-step at a time, instead of being required to elevate his legs the full height of a full step of the stairway. These steps can be accomplished while the user utilizes both, or only one, of his hands upon the rail H, whichever may be required by the physical condition of the user. Since both hands are free, much greater stability is provided for the user than when devices which require repeated movement of such devices from step to step are utilized, since such latter devices require that the user utilize one or both hands in order to move the half-step device from step to step, during which time the user has no adequate means for support or for stabilizing their balance.

My climbing aid, as described and shown hereinabove, is highly practical and cost-efficient. An entire unit can be manufactured and assembled for approximately $300.00 for a ten step unit, including liability insurance. More importantly, however, is the fact that this unit is untippable, and yet readily movable and of light weight, and is extremely stable because it extends snugly into the corner at the end of the step, and each unit is fixedly connected to the rigid elongated connector 23. Thus, each unit tends to stabilize the other and is positioned adjacent the rail H to enable the user to have maximum stability and balance while traversing the stairway.

It will be noted that it is relatively inexpensive, as compared to rebuilding stairways or installing an elevator. In addition, it substantially reduces the total effort which is required to traverse the stairway, and is substantially safer while this is being accomplished. Since most people having infirmities have balance problems, the substantially increased stability of this unit is particularly desirable. The result is that the user is much more independent and, in the case of convalescing patients, this greatly enhances the recovery of the patient. Thus the recovery time required for out-patients is substantially reduced through the use of this device, and the various floors of multi-storied buildings are made accessible, even though elevators or escalators therein are lacking. The mobility of the elderly and handicapped is thus greatly increased, as is their independence. This is important with respect to elderly and handicapped individuals. It will be noted that this unit also greatly reduces the energy required for a user in climbing such a flight of stairs.

It will, of course, be understood that various changes may be made in the form, details, arrangement and proportions of the parts without departing from the scope of the invention which comprises the matter shown and described herein and set forth in the appended claims.

I claim:

1. A stairway climbing aid comprising:

(a) a plurality of vertically spaced half-step members, each having vertical dimensions within a range approximately 3" to 4¾", and having upper and lower horizontal surfaces; and (b) a rigid, elongated, substantially planar connector fixedly connected at locations along its length spaced uniformly approximately 11" to 14" apart, to each of said members at a point intermediate said surfaces and rearwardly relative to said surfaces at an angle approximately 27° to 44° relative thereto.

2. The stairway climbing aid defined in claim 1, wherein said connector is comprised of an elongated channel member.

3. The structure defined in claim 1, wherein said connector is comprised of an elongated channel member and is secured to each of said half-step members by means of a bolt and rectangular nut, the latter having its greatest dimension slightly narrower that the width of the channel of said channel member.

4. The structure defined in claim 1, wherein at least some of said half-step members are each comprised of a pair of telescoping elements and means for securing said elements in fixed telescoped relation to each other.

5. The structure defined in claim 1, wherein at least some of said half-step members are each comprised of a pair of adjustably telescoping box-like members, and means for securing said box-like members in any one of a variety of telescoped positions.

6. The stairway climbing aid defined in claim 1, wherein said horizontal surfaces extend at an angle to said connector approximating 27° to 39°.

7. The structure defined in claim 1, wherein said horizontal surfaces extend at an angle to said connector approximating 33° to 40°.

8. The stairway climbing aid defined in claim 1, wherein said horizontal surfaces extend at an angle to said connector approximating 33° to 37°.

9. The stairway climbing aid defined in claim 1, wherein said horizontal surfaces extend at an angle to said connector approximating 30° to 34°.

10. The stairway climbing aid defined in claim 1, wherein each of said half-step members is connected directly to said connector.

11. The stairway climbing aid defined in claim 1, wherein each of said half-step members is connected directly to said connector and is otherwise devoid of connection to each other.

12. The stairway climbing aid defined in claim 1, wherein each of said half-step members is connected at one of its sides to said connector.

13. The stairway climbing aid defined in claim 1, wherein said entire climbing aid structure is portable as a unit.

14. The stairway climbing aid defined in claim 1, wherein said connector element is fixedly but adjustably secured to said half-step members.

15. The stairway climbing aid defined in claim 1, wherein said connector is fixedly secured to each of said half-step members at a point disposed approximately midway between said horizontal surfaces of said half-step members.

16. The stairway climbing aid defined in claim 1, wherein said connector is fixedly secured to each of said half-step members at a point disposed slightly below midway between said horizontal surfaces of said half-step members.

17. The stairway climbing aid defined in claim 1, wherein each of said half-step members have forward and rearward end portions and said connector is fixedly connected to said rearward end portions of each of said half-step members.

18. A stairway climbing aid comprising:

(a) a plurality of vertically spaced half-step members, each having vertical dimensions approximately one half the vertical dimensions of a conventional stairway riser and having opposite sides and upper and lower side edges; and (b) a rigid elongated connector fixedly connected at locations along its length spaced approximately 1 foot apart, to one side of each of said members at a point intermediate said edges, and extending downwardly and rearwardly past said edges at an angle approximately 27% to 44% relative thereto.

19. A stairway climbing aid comprising:

(a) a rectangularly shaped box-like member having rigid side walls and being open at one end;

(b) a slightly smaller and similarly shaped second box-like member having rigid side walls and being telescoped into said open end of said first mentioned box-like member;

(c) means associated with said box-like members for adjustably securing said members to each other in fixed telescoped relation in a variety of telescoping positions;

(d) each of said members having adjacent horizontal upper wall surfaces for supporting the weight of a human thereon; and (e) each of said members having vertical dimensions approximating one half the vertical dimensions of the riser of a conventional stairway.

20. The stairway climbing aid defined in claim 19, wherein said members include a fastening mechanism for fixedly securing the same to a rigid elongated connector.

* * * * *